United States Patent [19]

Rowland, Jr.

[11] 4,267,981

[45] May 19, 1981

[54] GRINDING SYSTEM AND METHOD UTILIZING CONSTANT FEED RATE SOURCE

[75] Inventor: Chester A. Rowland, Jr., Glendale, Wis.

[73] Assignee: Allis-Chalmers Corporation, Milwaukee, Wis.

[21] Appl. No.: 95,392

[22] Filed: Nov. 19, 1979

[51] Int. Cl.[3] ..... B02C 25/00

[52] U.S. Cl. ..... 241/30; 241/35; 241/44; 241/135; 241/137

[58] Field of Search ..... 241/21, 30, 34, 35, 241/44, 171, 135, 137

[56] References Cited

U.S. PATENT DOCUMENTS

| | | | |
|---|---|---|---|
| 2,613,878 | 10/1952 | Hailey | 241/35 |
| 4,179,074 | 12/1979 | Flavel | 241/34 X |

FOREIGN PATENT DOCUMENTS

| | | | |
|---|---|---|---|
| 513718 | 7/1976 | U.S.S.R. | 241/35 |
| 543407 | 3/1977 | U.S.S.R. | 241/35 |
| 641998 | 1/1979 | U.S.S.R. | 241/34 |
| 682269 | 9/1979 | U.S.S.R. | 241/35 |

*Primary Examiner*—Mark Rosenbaum

*Attorney, Agent, or Firm*—Robert C. Sullivan; Arthur M. Streich

[57] ABSTRACT

A grinding system and method for grinding mineral ore which is adapted for use where ore is required to be fed for grinding from a supply source at a substantially constant rate of feed, and in which the grinding characteristics of the ore and the power required to grind a predetermined weight of the ore vary unpredictably during the grinding operation, comprising a primary semi-autogenous grinding mill and a primary fully autogenous grinding mill connected in parallel relation with each other to the ore supply source, first drive means for driving the semi-autogenous grinding mill, power sensing means for measuring the input power required to drive the semi-autogenous grinding mill, and means for varying the ore feed rate to the semi-autogenous grinding mill whereby to maintain the input power to the semi-autogenous grinding mill at a substantially constant value or set point. Means is provided for measuring the rate of ore flow to the semi-autogenous grinding mill with the input power to semi-autogenous grinding mill being maintained at the substantially constant value. Means is provided for comparing the measured rate of ore flow to the semi-autogenous grinding mill with the substantially constant rate of feed required to be fed from the supply source whereby to obtain a differential value; and means is provided for adjusting the rate of ore flow to the fully autogenous grinding mill to correspond to said differential value whereby to cause the sum of the ore flow rates to the primary semi-autogenous grinding mill and to the primary fully autogenous grinding mill to be substantially equal to the substantially constant rate of feed required to be fed from the supply source.

16 Claims, 1 Drawing Figure

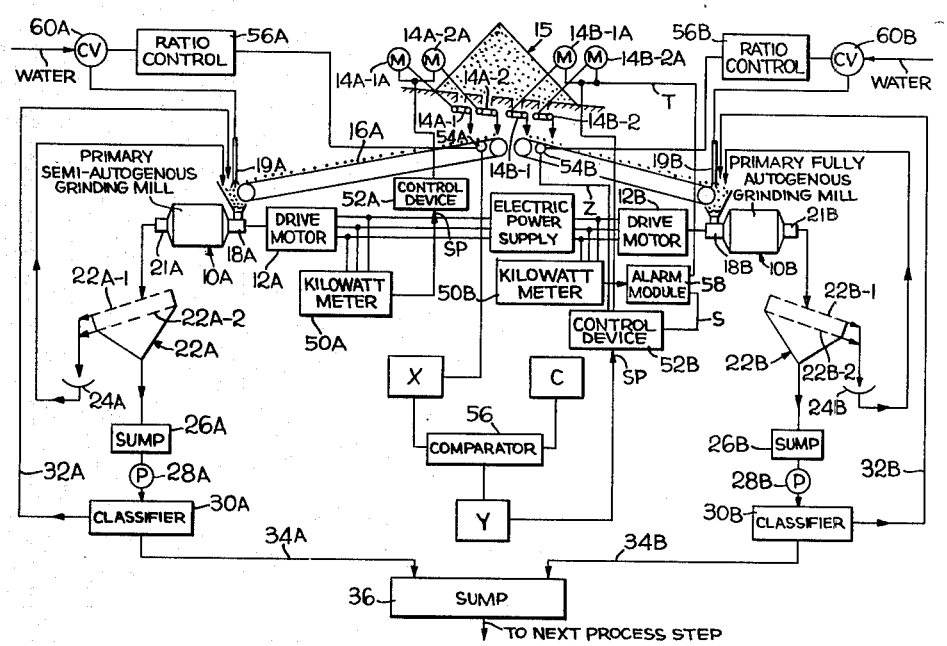

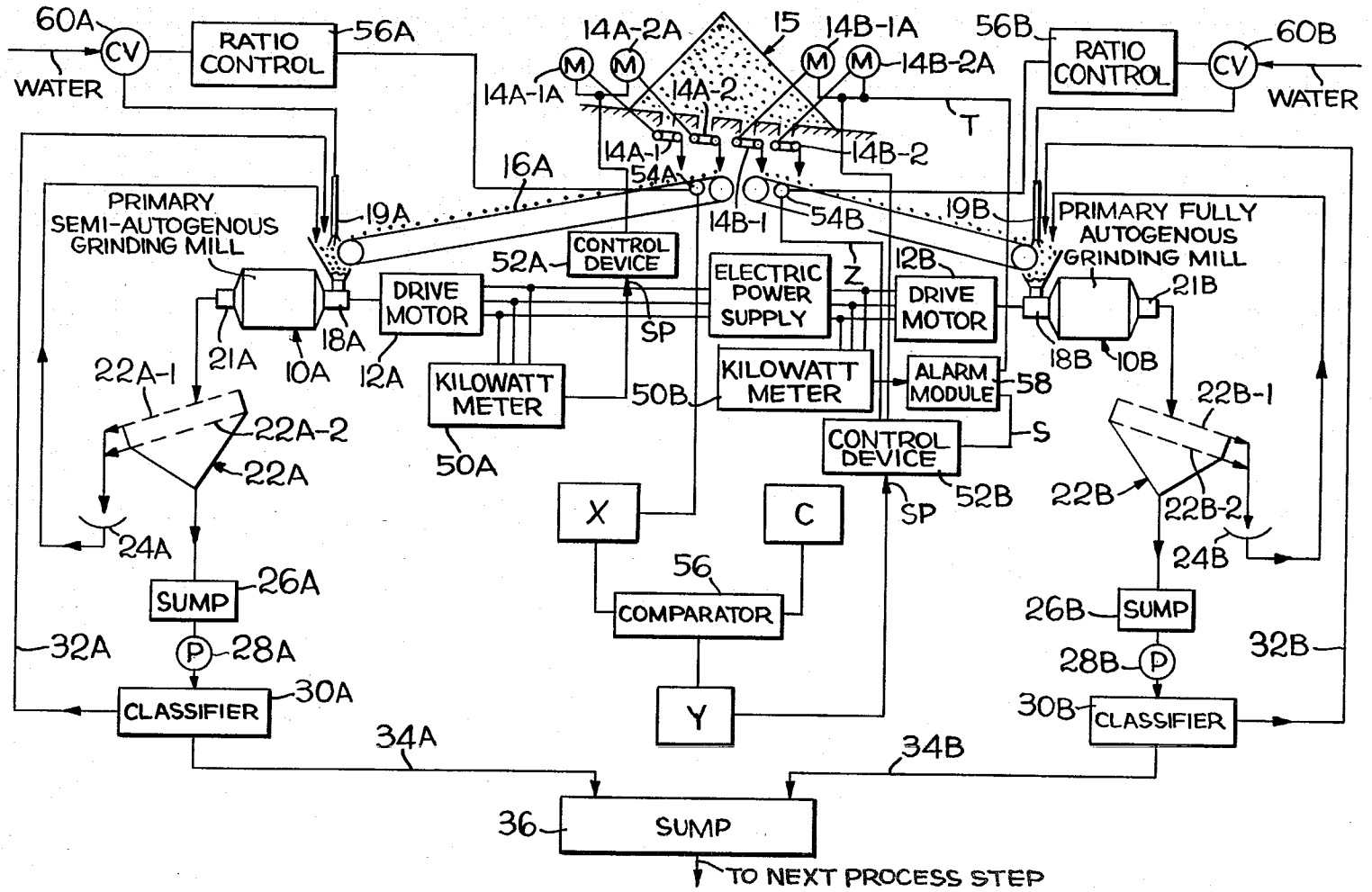
WATER
60B
CV
RATIO CONTROL
56B
PRIMARY FULLY AUTOGENOUS GRINDING MILL
21B
10B
18B
19B
22B-1
22B-2
22B
24B
SUMP
26B
28B
CLASSIFIER
30B
32B
34B
DRIVE MOTOR
12B
ALARM MODULE
58
S
CONTROL DEVICE
52B
SP
KILOWATT METER
50B
ELECTRIC POWER SUPPLY
Z
54B
14B-1
14B-2
14B-1A
14B-2A
T
15
14A-2
14A-1
54A
14A-2A
14A-1A
16A
CONTROL DEVICE
52A
SP
KILOWATT METER
50A
DRIVE MOTOR
12A
C
X
Y
56
COMPARATOR
SUMP
36
TO NEXT PROCESS STEP
WATER
60A
CV
RATIO CONTROL
56A
PRIMARY SEMI-AUTOGENOUS GRINDING MILL
21A
10A
18A
19A
22A-1
22A-2
22A
24A
SUMP
26A
28A
CLASSIFIER
30A
32A
34A

GRINDING SYSTEM AND METHOD UTILIZING CONSTANT FEED RATE SOURCE

TECHNICAL FIELD

This invention relates to a grinding system and method for grinding mineral ores and adapted for use in a situation in which the grinding apparatus is supplied from a constant feed rate source of ore.

BACKGROUND OF THE PRIOR ART

In semi-autogenous grinding mills and also in fully autogenous grinding mills, part (in the case of semi-autogenous mills) or all (in the case of fully autogenous mills) of the grinding is performed by "media size rock" having a rough diameter of approximately 4" to 12" and which is part of the ore being fed to the mill. When the input feed to the mill contains a sufficient quantity of the media size rock as just defined, then the input feed ore is considered for purposes of this specification to be "satisfactory" ore. Conversely, when there is not a sufficient amount of the media size rock in the input ore feed to the autogenous or to the semi-autogenous grinding mill, then the input ore is considered, for purposes of this specification, to be "unsatisfactory" ore.

In a very high percentage of mining operations, the ore delivered from the mine to the grinding mill contiguous to the mine varies unpredictably between what has been defined as "satisfactory" ore and what has been defined as "unsatisfactory" ore. It should be noted that the terms "satisfactory" and "unsatisfactory" ore refer to the geometry, size, and quantity of the pieces of ore in the media size range—that is, ore larger than 4" in size in the ore feed as it is fed to the grinding mill. The mineralogical characteristics of the ore can be and frequently are independent of the autogenous characteristics referred to as "satisfactory" ore and the "unsatisfactory" ore.

In the semi-autogenous grinding mill, metallic balls which typically are steel balls having a diameter in the range of 4" to 5" are used to supplement the grinding action of the "rock grinding media" defined by the larger size rocks in the input feed to the mill. Such a 5" steel ball would normally weigh approximately 18 pounds. The steel balls are much more dense than the rock grinding media and have much greater impact force than the rock grinding media.

A serious problem arises when a primary semi-autogenous grinding mill is being used for grinding mineral ore and either the mining procedure and/or the ore storage facilities upstream of the semi-autogenous grinding mill or, alternatively, the process downstream of the semi-autogenous grinding mill, cannot be adapted to handle the potentially wide variations in the ore thruput through the primary semi-autogenous grinding mill which is inherently necessary for satisfactory operation of the mill.

It is not practical to operate primary semi-autogenous grinding mills with a constant or uniform ore feed rate to the mill since with a constant feed rate to a primary semi-autogenous grinding mill when "satisfactory" ore (i.e., ore having good autogenous grinding characteristics) is the input feed to the grinding mill, the volumeteric load in the semi-autogenous mill can drop to an undesirably low level due to the greater autogenous grinding efficiency of the "satisfactory" ore. This drop in volumeteric load in the primary semi-autogenous grinding mill causes the metallic grinding balls used as supplemental grinding media in the mill to become exposed and also to become a larger proportion of the total charge in the mill. Exposure of the metallic grinding balls used as a supplemental grinding media causes greatly increased breakage of the balls due to ball-to-ball action. Also, as the metallic grinding balls become a greater percentage of the charge and become more exposed, they will impact to a greater degree on the mill lining, causing breakage of the mill lining. As the size of the "toe" in the charge is reduced, this increases the amount of breakage.

The problem just described in connection with the exposure of the metallic grinding balls in a semi-autogenous grinding mill is a particular problem in such mills because of the substantially higher peripheral velocity of a semi-autogenous grinding mill than conventional ball or rod mills. Autogenous and semi-autogenous grinding mills are typically 20' to 36' in diameter, as compared to a typical 15' to 18' diameter for conventional ball or rod mills. Because of their larger diameter, semi-autogenous mills have a substantially greater peripheral velocity than conventional ball or rod mills, as just mentioned. This higher peripheral velocity results in higher impact force of the balls on each other and on the liners when there are low "pulp" (i.e., slurry consisting of ore and water) levels in the semi-autogenous mill, with resulting damage to the balls and liners.

In view of the foregoing, it is much more practical to operate a primary semi-autogenous grinding mill at a predetermined constant power input and variable ore feed input to the mill, rather than at constant feed, variable power draw on the mill since with the constant input power, variable ore feed operation, the level of the pulp (i.e., the slurry consisting of the ore and water) in the semi-autogenous grinding mill can be constantly maintained at a predetermined optimum volumetric level in the mill so as to minimize breakage of the grinding balls and the mill liners.

It is known in the art of grinding mineral ores that semi-autogenous grinding mills have certain advantages as compared to fully autogenous grinding mills. These advantages may be briefly summarized as follows:

(1) The semi-autogenous grinding mill requires less input power per ton of the ore being ground;

(2) In most instances, the semi-autogenous grinding mill produces less fines or very fine grinding product than does the fully autogenous grinding mill. This could be an advantage in many processes for which the grinding mill output product is feed.

(3) Because of the use of metallic grinding balls, such as steel balls in the semi-autogenous grinding mill, there is more available grinding power in a semi-autogenous mill of a given size than in a fully autogenous grinding mill of the same size and volumeteric loading. This is due to the fact that the grinding action in a fully autogenous grinding mill is completely dependent upon the rock grinding media whereas in a semi-autogenous grinding mill steel balls having a much higher density or specific gravity than the rock grinding media are used to supplement the grinding action of the rock grinding media thereby providing greater grinding energy per unit volume in the semi-autogenous grinding mill than in the fully autogenous grinding mill.

(4) A further advantage of the semi-autogenous grinding mill is that there are more mineral ores suitable for semi-autogenous grinding than are available for fully autogenous grinding.

Because of the aforementioned advantages of a semi-autogenous grinding mill, it is often desirable to employ a semi-autogenous grinding mill for the grinding operation and yet the semi-autogenous grinding mill as a practical matter is only adapted for use when the mill is being supplied from a supply source which is capable of supplying the input feed ore to the grinding mill at a variable feed rate. However, certain types of mining operations are not adapted to provide a variable feed rate to the grinding mill. For example, an underground mine which depends for transport of the output of the mine upon hoists, conveyors, etc., cannot easily be accommodated to the variable input requirements of a semi-autogenous grinding mill but is better suited for delivery of a constant input feed rate to the grinding mill. On the other hand, an open pit mine where the ore can be hauled by rail or truck is better adapted to supply a variable ore feed rate input to the autogenous or semi-autogenous grinding mill.

STATEMENT OF THE INVENTION

Accordingly, it is an object of the present invention to provide a grinding system and method of grinding which permits the use of a primary semi-autogenous grinding mill in a situation in which from a grinding standpoint it is desired to use a semi-autogenous grinding mill but in which either the mining procedure and ore storage situation upstream of the grinding mill and/or the process downstream of the grinding mill cannot be adapted to handle the potentially wide variations of the ore and mill thruput normally inherent in the operation of a semi-autogenous primary grinding mill.

It is a further object of the invention to provide an improved system and method for grinding mineral ores which permits the use of a semi-autogenous grinding mill, and in which the mineral ore is fed at a substantially constant feed rate to the grinding circuit which includes the semi-autogenous grinding mill although the semi-autogenous grinding mill itself inherently is not adapted to be operated at a constant input feed rate.

It is a further object of the invention to provide an improved system and method for grinding mineral ores which employs a semi-autogenous primary grinding mill as the main grinding apparatus whereby to utilize the known and well recognized advantages of a semi-autogenous mill of mills but minimizes the disadvantages of the semi-autogenous grinding mill by utilizing in combination therewith a fully autogenous grinding mill, which is used as a balancing mill in the system thereby taking advantage of the more flexible characteristics available in a fully autogenous grinding mill.

It is another object of the invention to provide a grinding arrangement adapted for use in a system on which a constant rate of ore flow must be accommodated, which permits utilizing a semi-autogenous grinding mill, with the semi-autogenous mill being operated at a predetermined substantially constant power input, and with the pulp in the mill being maintained at an optimum volumetric level which minimizes breakage of the grinding balls and mill liners.

In achievement of these objectives, there is provided in accordance with the invention an apparatus and grinding system for grinding mineral ore which is adapted for use where ore is required to be fed for grinding from a supply source at a substantially constant rate of feed, and in which the grinding characteristics of said ore and the power required to grind a predetermined weight of said ore vary unpredictably during the grinding operation, comprising a primary semi-autogenous grinding mill and a primary fully autogenous grinding mill, said semi-autogenous grinding mill and said fully autogenous grinding mill being connected in parallel relation with each other to the ore supply source, first drive means for driving said semi-autogenous grinding mill, power sensing means for measuring the input power required to drive said semi-autogenous grinding mill, means for varying the ore feed rate to said semi-autogenous grinding mill whereby to maintain said input power required to drive said semi-autogenous grinding mill at a substantially constant value or set point, means for measuring the rate of ore flow to said semi-autogenous grinding mill with said input power to said semi-autogenous grinding mill being maintained at said substantially constant value, means for comparing the measured rate of ore flow to said semi-autogenous grinding mill with the substantially constant rate of feed required to be fed from said supply source whereby to obtain a differential value, and means for adjusting the rate of ore flow to said fully autogenous grinding mill to correspond to said differential value whereby to cause the sum of the ore flow rates to said primary semi-autogenous grinding mill and to said primary fully autogenous grinding mill to be substantially equal to said substantially constant rate of feed required to be fed from said supply source.

Further objects and advantages of the invention will become apparent from the following description taken in conjunction with the accompanying drawings in which:

BRIEF DESCRIPTION OF THE DRAWING

The sole FIGURE is a schematic view of the arrangement of the apparatus in the grinding system of the invention.

DESCRIPTION OF THE PREFERRED EMBODIMENT

Referring now to the drawing, there is shown a grinding circuit in accordance with the invention comprising a primary semi-autogenous grinding mill generally indicated at 10A driven by electrical drive motor 12A and a primary fully autogenous grinding mill generally indicated at 10B driven by electrical drive motor 12B. Mills 10A and 10B are arranged in parallel flow relation with each other in the grinding circuit. Each of the mills 10A and 10B is driven at a constant speed by its corresponding drive motor 12A or 12B. Motors 12A and 12B may be alternating current synchronous motors. The two grinding mills 10A and 10B both derive their input mineral ore supply from an ore supply generally indicated at 15 which may be mill feed bins or other suitable mill feed storage means. The ore supply to semi-autogenous mill 10A is provided by feeders 14A-1 and 14A-2 which are in underlying relation to the ore supply source 12. Feeders 14A-1 and 14A-2 are respectively driven by variable speed d.c. electric motors 14A-1A and 14A-2A. The feeders 14A-1 and 14A-2 dispense the ore onto an endless conveyor feed belt 16A which delivers the ore into the feed end 18A of primary semi-autogenous grinding mill 10A. Similarly, feeders 14B-1 and 14B-2 which are located in underlying relation to the ore supply 15 dispense ore onto the endlss conveyor feeder belt 16B which delivers ore to inlet end 18B of primary fully autogenous grinding mill 10B. Feeders 14B-1 and 14B-2 are respectively driven by variable speed d.c. electric motors 14B-1A and 14B-2A.

Instead of using variable speed d.c. electric motors to drive feeders 14A-1, 14A-2, 14B-1, 14B-2, the feeders may instead be driven by a suitable variable speed drive mechanism, as is well known in the art.

It should be noted that both of the grinding mills 10A and 10B are assumed to be operating in accordance with the wet grinding method in accordance with which the ore being ground in each of the mills is in the form of a water slurry. Water necessary to form the slurry is added to each of the respective grinding mills through an inlet indicated at 19A in connection with mill 10A and at 19B in connection with mill 10B. The water is necessary for producing a slurry and is admitted at the feed end of each of the respective grinding mills 10A and 10B.

When the grinding system is in operation, the two endless conveyor feeder belts 16A and 16B which respectively deliver ore to the mills 10A and 10B, run at a constant speed. However, as will be explained in more detail hereinafter, the two feeders 14A-1 and 14A-2 which deliver ore to feeder conveyor 16A have their speed controlled during the operation of the system in such manner as to deliver ore at a variable feed rate to semi-autogenous grinding mill 10A whereby to compensate for variations in the grinding characteristics of the ore being delivered to semi-autogenous grinding mill 10A and thus whereby to maintain a constant input horsepower to semi-autogenous primary grinding mill 10A. Also, the two feeders 14B-1 and 14B-2 which deliver ore to endless conveyor belt feeder 16B are controlled in such manner that the rate of ore delivery to autogenous grinding mill 10B always supplements the ore delivery rate to semi-autogenous primary grinding mill 10A so that the sum of the ore delivery rates to the two grinding mills 10A and 10B is always a substantially constant value C, as will be explained in more detail hereinafter. All of the feeders 14A-1, 14A-2, 14B-1 and 14B-2 are of similar construction and are conveyor-like members adapted to receive ore from the bottom of the ore storage bin and to discharge the ore thus received onto a conveyor feeder belt such as 16A or 16B. The two feeders 14A-1 and 14A-2 are controlled in unison with each other to control the ore delivery rate to semi-autogenous primary grinding mill 10A; and the two feeders 14B-1 and 14B-2 are controlled in unison with each other to control the ore delivery rate to fully autogenous primary grinding mill 10B.

Each of the grinding mills 10A and 10B is connected in a similar closed grinding circuit and the grinding ciurcuit of semi-autogenous mill 10A will be described as typical of the grinding circuits of both the mills 10A and 10B. Thus, the ground product of the semi-autogenous mill 10A is discharged from discharge end 21A of mill 10A into a classifying means in the form of a 2-deck classifying screen generally indicated at 22A including an upper screen deck 22A-1 and a lower screen deck 22A-2. The oversize which is retained on upper screen deck 22A-1 is discharged onto a conveyor 24A. Similarly, the material which passes through upper screen deck 22A-1 but is retained on lower screen deck 22A-2 is discharged onto conveyor 24A and is comingled with the oversize from upper deck screen 22A-1. Comingled oversize material from the two screen decks of classifying screen 22A are then carried by conveyor 24A back into the feed end 18A of grinding mill 10A for recycling. The undersize material from classifying screen 22A which has passed through both of the screen decks 22A-1 and 22A-2 passes to sump 26A from whence it is pumped by pump 28A to a classifying device 30A which may be, for example, a cyclone classifier or, alternatively, a fine sizing screen either of which is located at an elevation higher than the mill. The oversize material discharged by classifying device 30A passes into conduit 32A through which it is delivered by gravity to feed end 18A of semi-autogenous primary grinding mill 10A. All of the ore returned to the mill for further grinding is called circulation load. The undersize material or fines discharged by classifier 30A passes by conduit 34A to a sump and distributor schematically indicated at 36 from whence it is discharged to the next process step.

An alternative to the 2-deck screen is to mount a rotating screen on the discharge end of the mill. This type of screen is commonly referred to as a trommel screen. The oversize may return to the feed end of the semi-autogenous mill 10A by the conveyor 24A or it can be returned to mill through the discharge end by being moved through an oversize return pipe passing through the interior of the trommel along its horizontal centerline.

In an alternative circuit arrangement, if the undersize or fines from screen deck 22A-2 or the trommel is ore of acceptable size without further classification, classifier 30A may be eliminated from the grinding circuit, and the fines from screen deck 22A-2 or the trommel may be pumped by pump 28A directly to sump 36.

The grinding circuit of the fully autogenous grinding mill 10B is similar to that just described in connection with grinding mill 10A and will not be described in detail again except to point out that similar components of the grinding circuits of the two mills 10A and 10B are indicated by the same reference numeral but the respective reference numerals have the subscript "A" in the circuit of grinding mill 10A and have the subscript "B" in the circuit of grinding mill 10B.

DESCRIPTION OF CONTROL SYSTEM FOR GRINDING CIRCUIT AND METHOD OF GRINDING

In accordance with the invention, a control system is provided to control the operation of primary semi-autogenous grinding mill 10A and primary fully autogenous grinding mill 10B in such manner that semi-autogenous grinding mill 10A operates at a constant power draw with a variable rate of feed of the ore to the semi-autogenous grinding mill. The constant power draw at which the semi-autogenous mill 10A is operated may be, but is not necessarily the maximum input power rating of mill 10A to thereby maximize the utilization of semi-autogenous mill 10A. Since the grinding characteristics of the ore fed through semi-autogenous grinding mill 10A may be constantly varying, requiring varying power inputs to the semi-autogenous grinding mill for a given weight of ore depending on the varying grinding characteristics of the ore, means are provided to vary the feed rate of the ore to semi-autogenous primary grinding mill 10A to maintain the power input to mill 10A substantially at a predetermined constant value.

In the operation of the semi-autogenous grinding mill 10A in accordance with the invention, the following conditions prevail:

(1) The power input to mill 10A is maintained substantially constant at a predetermined value. In order to maintain the power input to mill 10A at a constant value, the rate of input ore feed to mill 10A varies in accordance with the nature of the ore, there being a higher rate of feed for "satisfactory" ore having good autogenous grinding characteristics, and a lower rate of feed for "unsatisfactory" ore having poor autogenous grinding characteristics.

(2) There is a substantially constant volume of "pulp" (slurry of ore and water) in semi-autogenous grinding mill 10A, and the value of constant power input to mill 10A should be so selected as to provide an optimum volumetric loading of mill 10A at which ball breakage and liner breakage is minimized. For any given value of constant power input to mill 10A, there is a corresponding volumetric loading of mill 10A, and hence the value of constant power input to be maintained on mill 10A is selected to provide an optimum volumetric loading of mill 10A.

(3) There is a variable rate of undersize ore output in line 34A which is equal to the variable rate of ore input from feeder belt 16A to semi-autogenous mill 10A.

In the control arrangement for semi-autogenous grinding mill 10A means diagrammatically indicated in the form of a kilowatt meter 50A or other suitable power transducer is connected across the electrical input lines to electrical drive motor 12A for primary semi-autogenous grinding mill 10A. Kilowatt meter 50A transmits a suitable control signal to control device 52A which senses any departure of the electrical power input to drive motor 12A from a predetermined set point SP corresponding to the maximum power rating of mill 10A. Control device 52A can be an analog controller with either remote or local input, such as the SYBRON/TAYLOR 1300 K Series indicating controller manufactured by Taylor Instrument Company, 95 Ames Street, Rochester, NY, shown on Sybron/Taylor Product Data Sheet PDS -11E001, Issue 5. Control device 52A is suitably connected to the electric motors 14A-1A and 14A-2A which drive the respective feeders 14A-1 and 14A-2 to control the supply of mineral ore being fed to semi-autogenous grinding mill 10A. If control device 52A senses a power input to mill 10A which is less than the set point corresponding to the predetermined constant input power which it is desired to maintain on mill 10A, control device 52A transmits an electrical output signal to motors 14A-1A and 14A-2A which causes the corresponding feeders 14A-1 and 14A-2 to increase their rate of delivery of ore to feed belt 16A and thus to the semi-autogenous primary grinding mill 10A. Conversely, if control device 52A senses a power input to semi-autogenous grinding mill 10A which is greater than the set point corresponding to the predetermined constant input power which it is desired to maintain on mill 10A, control device 52A transmits an electrical output signal to motors 14A-1A and 14A-2A to cause the corresponding feeders 14A-1 and 14A-2 to diminish the rate at which they feed mineral ore from supply 15 to feeder conveyor belt 16A and thus to primary semi-autogenous grinding mill 10A. Thus, power measuring means 50A and control means 52A cooperate to control the rate at which feeders 14A-1 and 14A-2 dispense mineral ore to feeder belt 16A whereby to control the ore feed rate to primary semi-autogenous grinding mill 10A in such manner as to cause semi-autogenous grinding mill 10A to operate at the predetermined substantially constant power input.

As a further feature of the control system, a belt scale 54A is positioned in underlying relation to the feeder conveyor 16A which delivers ore to semi-autogenous primary grinding mill 10A. Belt scale 54A provides a continuous indication of the weight in tons per hour of the mineral ore being carried by feeder conveyor 16A at any given moment. Belt scales are well known in the art and are commercially available. See "Handbook of Mineral Dressing - Ores and Industrial Minerals" — by Arthur F. Taggart, New York, John Wiley & Sons, Inc., 1945, Sec. 18, Article 25. Belt scales such as belt scales 54A and 54B are commercially available from various manufacturers, including Ramsey Engineering Company, 1853 West County Road C, St. Paul, MN 55113. Belt scale 54A transmits a signal diagrammatically indicated in block diagram form as "X" in the view of the sole figure, signal X being proportional to the feed rate of the mineral ore in tons per hour being delivered by feeder conveyor 16A at any given moment. Signal X is fed into a comparator 56. Comparator 56 can be a subtractor similar to Rochester Instrument Systems, Inc., Model SC-1354, manufactured by Rochester Instrument Systems, Inc., 255 North Union Street, Rochester, NY, as shown in their product data bulletin No. 1354. A Signal "C" is also fed into comparator 56, signal C being proportional to the required constant delivery rate of the ore to the total grinding system comprising both mills 10A and 10B. Signal C may be provided by a manual loading station with a manually adjustable output which is adjusted to be proportional to or representative of the value C. The manual loading station may be of the type provided by SYBRON/-TAYLOR 1340 N Series, manufactured by Taylor Instrument Co., 95 Ames Street, Rochester, NY, and shown by SYBRON/TAYLOR product data sheet PDS-21E001, Issue 3. Comparator 56 compares signals X and C and produces an output signal indicated diagrammatically at "Y" which is proportional to the difference between signals C and X. Therefore, signal Y is proportional to the rate of feed of the ore which should be delivered at the given moment to primary fully autogenous grinding mill 10B in order that the sum of the feed rates to the two mills 10A and 10B will always be equal to the required constant feed rate "C" to the entire grinding system. Signal Y is transmitted to a control device 52B which, in turn, transmits an output signal to motors 14B-1A and 14B-2A which drive two feeders 14B-1 and 14B-2 which control the rate at which mineral ore is deposited on the feeder belt 16B which delivers ore to fully autogenous grinding mill 10B in accordance with the remote set point given by Y. The set point maintained by control device 52B is variable since the output Y of comparator 56 is a variable.

A belt scale 54B, similar to belt scale 54A previously described, is positioned beneath the belt conveyor 16B which delivers ore to fully autogenous grinding mill 10B. Belt scale 54B provides a continuous signal Z which is proportional to the weight in tons per hour of the mineral ore actually being carried by feeder conveyor 16B at any given moment. Signal Z from belt scale 54B is fed into control device 52B to provide adjustment and control of the input feed to fully autogenous mill 10B to conform the feed to fully autogenous mill 10B to the variable set point established by signal Y.

Control device 52B can be an analog controller such as Leeds and Northrup "Centry" (TM) 440 process controller manufactured by Leeds and Northrup Co., Sumneytown Pike, North Wales, PA, and shown in Leeds and Northrup Bulletin CO 6811-DS. The rate at which feeders 14B-1 and 14B-2 feed ore to fully autogenous grinding mill 10B is therefore adjusted by signal Y so that the sum of the feed rates to the two mills 10A and 10B is equal to the desired constant feed rate from ore supply source 15 to the grinding system.

The fully autogenous primary grinding mill 10B is operated at a variable ore feed input, depending upon the feed input to mill 10B necessary to make the total ore feed rate to mills 10A and 10B equal to the desired constant ore flow rate C, as previously explained. However, to prevent fully autogenous mill 10B from becoming overloaded with more or than it can handle the maximum power draw or power input to fully autogenous mill 10B as measured by kilowatt meter or power transducer 50B should not be permitted to exceed the maximum rated power draw of mill 10B.

In order to prevent the power input to fully autogenous primary grinding mill 10B from exceeding its maximum rating, an alarm module 58 connected to kilowatt meter 50B and responsive to the reading of kilowatt meter 50B transmits a signal S to control device 52B when the input power draw of mill 10B reaches the maximum rating of mill 10B. The alarm module can be of the type manufactured by Rochester Instruments Systems, Inc. of 255 North Union Street, Rochester, NY and designated as Series PTA-215, with dual trip, as shown on Rochester Instrument Systems Data Bulletin, PTA-214. Signal S instructs control device 52B to hold its present position. Should the power draw by fully autogenous grinding mill 10B continue to increase beyond the maximum power rating of mill 10B, alarm module 58 will send a signal T to feeder motors 14B-1A and 14B-2A which will either greatly reduce or completely shut down feeders 14B-1 and 14B-2 which feed ore to feeder conveyor 16B and thus to the input of fully autogenous mill 10B.

The alarm module can be of the type manufactured by Rochester Instrument Systems, Inc. of 255 North Union Street, Rochester, NY, and designated as Series PTA-215, with dual trip, as shown in Rochester Instrument Systems Data Bulletin, PTA-214.

In extreme cases, the alarm module 58 and signal T transmitted by alarm module 58 to feeder motors 14B-1A and 14B-2A may limit ore feed rate to autogenous mill 10B sufficiently that the total ore flow rate to both mills 10A and 10B may drop below the desired constant ore flow rate C which, in turn, may affect the situation upstream or downstream of mills 10A and 10B. However, the reduction in the total ore flow rate to the system to a value less than C in this hypothetical extreme condition as just described, while it might cause disturbances upstream or downstream of mills 10A and 10B, will not adversely affect semi-autogenous grinding mill 10A in any manner.

If the output signal of comparator 56 indicates that signal X is equal to or greater than C, then the output signal Y of comparator 56 equals zero, causing the delivery rate of ore to autogenous grinding mill 10B to be maintained at zero level. Suitable interlock means shuts down fully autogenous grinding mill 10B and all of the moving equipment in the grinding circuit of mill 10B until such time that signal X is less than C.

The water admitted through the respective inlets 19A and 19B to the inlet ends of the respective mills 10A and 10B is added in proportion to the mill feed rate.Thus, as seen in connection with semi-autogenous mill 10A, a signal is transmitted from belt scale 54A to a ratio control device which controls control valve 60A to control the rate at which water is admitted through inlet 19A to semi-autogenous mill 10A to form the ore slurry. The water admitted through inlet 19B to fully autogenous mill 10B is added in proportion to the feed rate to mill 10B in a similar manner to that just described for mill 10A, including transmission of a single from belt scale 54B to a ratio control device 56B which adjusts control valve 60B in the same manner as previously described in connection with mill 10A. Ratio control devices such as 60A and 60B are per se well known in the art. For example, ratio control devices 60A and 60B could each respectively be an analog controller such as a Leeds and Northrup "Centry" (TM) 440 process controller, manufactured by Leeds and Northrup Company, Sumneytown Pike, North Wales, PA, as shown in Leeds and Northrup Bulletin CO6811-DS.

It should be noted that in the system and method hereinbefore described, the volume of "pulp" (i.e., slurry of ore and water) remains substantially constant at an optimum volumetric loading in semi-autogenous mill 10A, corresponding to the constant power input maintained to mill 10A, the volume of the "pulp" in the mill being such as described in the introductory portion of this specification, as to minimize breakage of the grinding balls and damage to the mill liners.

It should also be noted that the semi-autogenous grinding mill or mills 10A used in the system should have a ball charge in the range of about six to about ten percent of the internal volume of mill 10A, which is typical of semi-autogenous grinding mills, to supplement the grinding action of the rock grinding media. The fully autogenous grinding mill 10B, if strictly fully autogenous, does not have any ball charge whatever and fully autogenous mill 10B is normally operated only with rock grinding media as the grinding medium and without any supplemental grinding media such as steel balls. However, it is within the scope of this invention to operate the mill 10B which has been described as a fully autogenous primary grinding mill, as a semi-autogenous mill with a ball charge of not more than about 2 percent of the internal volume of mill 10B to supplement the rock grinding media, and mill 10B, if operated with the ball charge of not more than about 2 percent of the mill volume, which is substantially lower than the ball charge normally required for semi-autogenous grinding, is operated in conjunction with a semi-autogenous mill 10A having a ball charge in the typical range of about 6 percent to about 10 percent of the internal volume of mill 10A.

The control system is so arranged that although the various conditions being sensed are sensed or monitored continuously, in order to avoid "hunting" of the system, corrections to restore the sensed condition to a predetermined desired value are not initiated immediately, but instead the necessary correction is applied only after the sensed abnormality has continued for a predetermined time, such as one or two minutes.

While the invention has been shown and described as including a single primary semi-autogenous grinding mill 10A and a single primary fully autogenous grinding mill 10B, it is within the scope of the invention to utilize a plurality of primary semi-autogenous grinding mills such as 10A connected in parallel with each other, and which collectively operate in parallel with at least one primary fully autogenous grinding mill such as 10B. The number of fully autogenous mills used will be no more than the number needed to produce the desired balance to give a constant total feed rate C.

While the apparatus and system of the invention have been described and shown as embodied in a wet grinding process employing a slurry, it is to be understood that the apparatus and system of the invention are equally applicable for use with a dry process in which water is not added to the ore to form a slurry.

From the foregoing detailed description of the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. A method of grinding mineral ore which is adapted for use where ore is required to be fed for grinding from a supply source at a substantially constant rate of feed and in which the grinding characteristics of said ore and the power required to grind a predetermined weight of said ore vary unpredictably during the grinding operation comprising the steps of:

(1) connecting a primary semi-autogenous grinding mill and a primary fully autogenous grinding mill in parallel relation with each other to an ore supply source;

(2) measuring the input power required to drive said semi-autogenous grinding mill;

(3) varying the ore feed rate to said semi-autogenous grinding mill whereby to maintain the input power required to drive said semi-autogenous grinding mill at a substantially constant value or set point;

(4) measuring the rate of ore flow to said semi-autogenous grinding mill with said input power to said semi-autogenous grinding mill being maintained at said substantially constant value;

(5) comparing the measured rate of ore flow to said semi-autogenous grinding mill with the substantially constant rate of ore flow required from said supply source whereby to obtain a differential value;

(6) and adjusting the rate of ore flow to said fully autogenous grinding mill to correspond to said differential value whereby to cause the sum of the ore flow rates to said primary semi-autogenous grinding mill and to said primary fully autogenous grinding mill to be substantially equal to said substantially constant rate of feed required to be fed from said supply source.

2. A method of grinding mineral ore as defined in claim 1 in which said semi-autogenous grinding mill is operated at a predetermined substantially constant power input which corresponds to an optimum volumetric loading of said semi-autogenous grinding mill at which breakage of grinding balls and of mill liners is minimized.

3. A method of grinding mineral ore as defined in claim 1 in which each of said grinding mills is driven at a constant speed.

4. A method of grinding mineral ore as defined in claim 1 in which said semi-autogenous grinding mill has a ball charge in the range of about 6 percent to about 10 percent of the internal volume of said semi-autogenous mill.

5. A method of grinding mineral ore as defined in claim 1 in which said fully autogenous grinding mill contains zero ball charge and depends for the grinding action solely upon the rock grinding media.

6. An apparatus and grinding system for grinding mineral ore which is adapted for use where ore is required to be fed for grinding from a supply source at a substantially constant rate of feed, and in which the grinding characteristics of said ore and the power required to grind a predetermined weight of said ore vary unpredictably during the grinding operation, comprising a primary semi-autogenous grinding mill and a primary fully autogenous grinding mill, said semi-autogenous grinding mill and said fully autogenous grinding mill being connected in parallel relation with each other to the ore supply source, first drive means for driving said semi-autogenous grinding mill, power sensing means for measuring the input power required to drive said semi-autogenous grinding mill, means for varying the ore feed rate to said semi-autogenous grinding mill whereby to maintain said input power required to drive said semi-autogenous grinding mill at a substantially constant value or set point, means for measuring the rate of ore flow to said semi-autogenous grinding mill with said input power to said semi-autogenous grinding mill being maintained at said substantially constant value, means for comparing the measured rate of ore flow to said semi-autogenous grinding mill with the substantially constant rate of feed required to be fed from said supply source whereby to obtain a differential value, and means for adjusting the rate of ore flow to said fully autogenous grinding mill to correspond to said differential value whereby to cause the sum of the ore flow rates to said primary semi-autogenous grinding mill and to said primary fully autogenous grinding mill to be substantially equal to said substantially constant rate of feed required to be fed from said supply source.

7. An apparatus and grinding system as defined in claim 6 in which said semi-autogenous grinding mill is operated at a predetermined substantially constant power input which corresponds to an optimum volumetric loading of said semi-autogenous grinding mill at which breakage of grinding balls and of mill liners is minimized.

8. As apparatus and grinding system as defined in claim 6 in which said semi-autogenous grinding mill has a ball charge in the range of about 6 percent to about 10 percent of the internal volume of said semi-autogenous mill.

9. An apparatus and grinding system as defined in claim 6 in which said fully autogenous grinding mill contains zero ball charge and depends for the grinding action solely upon the rock grinding media.

10. An apparatus and grinding system as defined in claim 6 including means for introducing water into each of said mills to form a slurry of ore and water in each mill, and means for proportioning the rate of water flow to each mill in accordance with the ore flow rate to the respective mill.

11. An apparatus and grinding system as defined in claim 6 in which each of said grinding mills is driven at a constant speed.

12. An apparatus and grinding system as defined in claim 6 comprising a first feeder means adapted to remove ore from a supply source and to direct said ore thus removed toward said semi-autogenous grinding mill, first drive means for said first feeder means, a control means, means connecting said power sensing means to said control means whereby to provide an input signal to said control means proportional to the power input to said semi-autogenous grinding mill and means connecting said control means to said first drive means for said first feeder means whereby to vary the rate at which said first feeder means operates to direct ore to said semi-autogenous grinding mill whereby to maintain substantially constant power input to said semi-autogenous grinding mill.

13. An apparatus and grinding system for grinding mineral ore which is adapted for use where ore is required to be fed for grinding from a supply source at a substantially constant rate of feed, and in which the grinding characteristics of said ore and the power required to grind a predetermined weight of said ore vary unpredictably during the grinding operation, a first and a second grinding mill connected in parallel relation with each other to the ore supply source, said first mill being a primary semi-autogenous grinding mill, said second mill being of the autogenous type, first drive means for driving said semi-autogenous grinding mill, power sensing means for measuring the input power required to drive said semi-autogenous grinding mill, means for varying the ore feed rate to said semi-autogenous grinding mill whereby to maintain said input power required to drive said semi-autogenous grinding mill at a substantially constant value or set point, means for measuring the rate of ore flow to said semi-autogenous grinding mill with said input power to said semi-autogenous grinding mill being maintained at said substantially constant value, means for comparing the measured rate of ore flow to said semi-autogenous grinding mill with the substantially constant rate fo feed required to be fed from said supply source whereby to obtain a differential value, and means for adjusting the rate of ore flow to said second grinding mill to correspond to said differential value whereby to cause the sum of the ore flow rates to said primary semi-autogenous grinding mill and to said second grinding mill to be substantially equal to said substantially constant rate of feed required to be fed from said supply source.

14. An apparatus and grinding system as defined in claim 13 in which said semi-autogenous grinding mill is operated at a predetermined substantially constant power input which corresponds to an optimum volumetric loading of said semi-autogenous grinding mill at which breakage of grinding balls and of mill liners is minimized.

15. An apparatus and grinding system as defined in claim 13 in which said semi-autogenous grinding mill has a ball charge in the range of about 6 percent to about 10 percent of the internal volume of said semi-autogenous mill.

16. An apparatus and grinding system as defined in claim 13 in which said second grinding mill has a ball charge of not more than about two percent of the internal volume of said second grinding mill.

* * * * *